US012330841B2

(12) United States Patent
Pather

(10) Patent No.: US 12,330,841 B2
(45) Date of Patent: Jun. 17, 2025

(54) DISPLAY CASE AND METHOD OF ASSEMBLY

(71) Applicant: 13872548 Canada Inc., Markham (CA)

(72) Inventor: Ethan Pather, Toronto (CA)

(73) Assignee: 13872548 Canada, Inc., Markham (CA)

( * ) Notice: Subject to any disclaimer, the term of this patent is extended or adjusted under 35 U.S.C. 154(b) by 202 days.

(21) Appl. No.: 18/188,817

(22) Filed: Mar. 23, 2023

(65) Prior Publication Data

US 2023/0294879 A1 Sep. 21, 2023

Related U.S. Application Data

(60) Provisional application No. 63/321,632, filed on Mar. 18, 2022.

(51) Int. Cl.
*B65D 25/02* (2006.01)
*B65D 25/22* (2006.01)
*B65D 25/54* (2006.01)

(52) U.S. Cl.
CPC ..... *B65D 25/02* (2013.01); *B65D 25/22* (2013.01); *B65D 25/54* (2013.01)

(58) Field of Classification Search
CPC ..... B65D 25/02; B65D 25/22; B65D 25/54; B65D 15/24; A47F 3/005; A47F 8/00; A47B 47/025; A47B 47/042
See application file for complete search history.

(56) References Cited

U.S. PATENT DOCUMENTS 3,347,610 A * 10/1967 Pilliod ..... A47B 47/04 312/263
4,402,397 A 9/1983 Spence
4,553,680 A * 11/1985 Griggs ..... A47F 3/005 D6/661
5,359,944 A * 11/1994 Steinbeck ..... A47B 91/02 403/294
5,524,977 A * 6/1996 Orawski ..... A47F 3/005 312/265.5
6,722,747 B2 * 4/2004 House ..... A47F 3/005 312/224
6,732,462 B1 5/2004 Kramer
7,134,725 B2 11/2006 Cummings
7,591,097 B2 9/2009 Alman
(Continued)

*Primary Examiner* — Ko H Chan
(74) *Attorney, Agent, or Firm* — Cherskov Flaynik & Gurda, LLC

(57) ABSTRACT

A display case and assembly method are provided that allow the display of collectible items while being easy to assemble and disassemble. The display case includes a bottom and top panel, side panels, back panel, and front panel. The panels join together through elongated grooves on the bottom, top and side panels, and the side panels are secured with specialty hardware. The display case is assembled by inserting side panels into an elongated groove on a bottom panel, securing the side panels with specialty hardware, attaching a top bracket, inserting a back panel into an elongated groove in the side panels and bottom panel, inserting a front panel into an elongated groove in each of the side panels and the bottom panel, joining a top panel by inserting the side panels, back panel and front panel into an elongated groove in the top panel, and securing the top panel with specialty hardware.

20 Claims, 18 Drawing Sheets

(56) References Cited

U.S. PATENT DOCUMENTS

| | | | | |
|---|---|---|---|---|
| D687,658 | S * | 8/2013 | Wilson | D6/661 |
| D700,462 | S * | 3/2014 | Boos | D6/661 |
| 9,826,828 | B1 * | 11/2017 | Vaughan, Jr. | F16B 12/46 |
| 2006/0273085 | A1 * | 12/2006 | Casto | B27G 13/14<br>403/381 |
| 2008/0047186 | A1 | 2/2008 | Strickland | |
| 2009/0223991 | A1 * | 9/2009 | Lorenzati | A47K 10/421<br>221/34 |
| 2017/0008672 | A1 * | 1/2017 | Pitera | B65D 43/16 |
| 2017/0259959 | A1 * | 9/2017 | Nilsson | A47B 57/48 |
| 2023/0329467 | A1 * | 10/2023 | Caldwell | A47F 3/005 |

* cited by examiner

FRONT SIDE

LEFT SIDE

BACK SIDE

RIGHT SIDE

DISPLAY CASE AND METHOD OF ASSEMBLY

The present patent claims priority as a non-provisional of U.S. provisional application 63/321,632 filed on Mar. 18, 2022, the contents of which are hereby incorporated by reference.

TECHNICAL HELD

The present disclosure generally relates to a display case and, more specifically, to a collectibles display case.

BACKGROUND

Collectible items, for example, hockey, jerseys, football helmets, and baseballs are often placed on display for private or public observation. A display case for such items may be provided with a transparent panel to protect the item on display while allowing the item to be viewed. However, such display cases are typically difficult to open and close for placing the item inside, are bulky for shipping, and do not provide a system for arranging the item in the case to allow a pleasing view of the item in the case.

What is lacking in the field is a device and method for a display case that is simple to assemble and disassemble, allows a pleasing arrangement of an item in the display case, and is simple to ship.

SUMMARY

In the present disclosure, a display case and method for its assembly is disclosed that enables a pleasing display of an item, can be adjusted for different display items, and is simple to assemble, disassemble, and exchange display items inside.

In a first aspect of the present invention, there is provided a display case including a bottom panel and a top panel, the bottom panel and top panel each having an inner face and an outer face, the inner face including an elongated groove that inscribes the inner face substantially, parallel to an outer edge of the inner face and including a plurality of specialty hardware holes extending from the inner face elongated groove to the outer face. The display case also includes first and second opposing side panels, each side panel having a front edge and an opposing back edge; a side panel top edge and an opposing side panel bottom edge, the top edge and bottom edge each extending from the side panel front edge to the side panel back edge and including a plurality of specialty hardware holes extending into the top edge and the bottom edge. A side panel inner face and a side panel outer face are defined by the side panel front edge, back edge, top edge, and bottom edge. The side panel inner face includes a first and second side panel elongated groove substantially parallel to the side panel back edge and the side panel front edge respectively, wherein the first and second side panels join the top panel and the bottom panel by inserting the side panel bottom edge into the bottom panel elongated groove and the side panel top edge into the top panel elongated groove and fastening the bottom panel and top panel through the specialty hardware holes in the bottom panel, the top panel and the side panels. The display case also includes a top bracket that extends from a top portion of the first side panel to a top portion of the second side panel, a back panel that cooperates with the bottom panel, top panel and first and second side panels by inserting into the bottom panel elongated groove, the first side panel elongated grooves and the top panel elongated groove, and a transparent front panel that cooperates with the bottom panel, top panel and first and second side panels by inserting into the bottom panel elongated groove, the second side panel elongated grooves and the top panel elongated groove to form an interior space.

In a further aspect of the present invention, there is provided a method for assembling a display case including joining a first and second side panel to a bottom panel by inserting the first and second side panels into an elongated groove in an inner face of the bottom panel, securing the side panels to the bottom panel with fasteners through specialty hardware holes in the bottom panel and the side panels, attaching a top bracket to an upper portion of the first and second side panels to stabilize the side panels, inserting a back panel into a first elongated groove in an inner face of each of the side panels and the elongated groove in the inner face of the bottom panel, inserting a transparent front panel into a second elongated groove in the inner face of each of the side panels and the elongated groove in the inner face of the bottom panel, joining a top panel by inserting the side panels, back panel and front panel into an elongated groove in an inner face of the top panel, and securing the top panel to the side panels with fasteners through specialty hardware holes in the top panel and the side panels.

A more complete understanding of the disclosure can be obtained by reference to the following detailed description in connection with the attached drawings.

The drawings provided herein are presented for convenience to explain the functions of the elements included in the described embodiments of the device and its method of use. Elements and details that are obvious to a person skilled in the art may not have been illustrated. Conceptual sketches have been used to illustrate elements that would be readily understood in the light of the present disclosure. Some details have been exaggerated for clarity. These drawings are not fabrication drawings and should not be scaled.

DETAILED DESCRIPTION

The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

The following description refers to a device and method of assembly for a display case. The examples provided describe a collectible sports garment display case; however, it will be understood by those skilled in the art that the disclosure provided may be applied to other items for display in a display case.

Referring to FIG. 1A-E, embodiments of the display case 100 are provided. The display case 100 may be rounded, rectangular or square, or a combination thereof. The height of the display case 100 may also vary, depending on the item to be displayed. It can attach to a wall or it can sit on a flat surface.

Figures 1A, 1B, 1C, 1D, 1E:
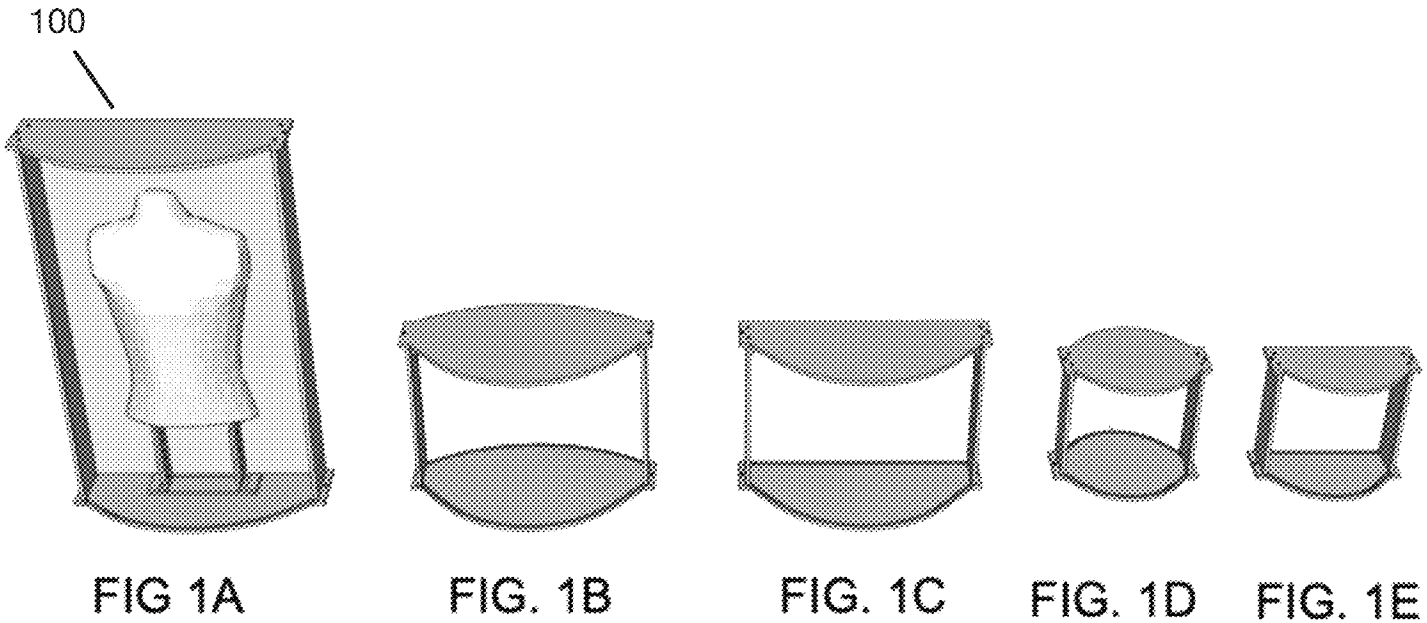
FIGS. 1A-E illustrate non-limiting embodiments of a display case according to the present disclosure.
Figure 2:
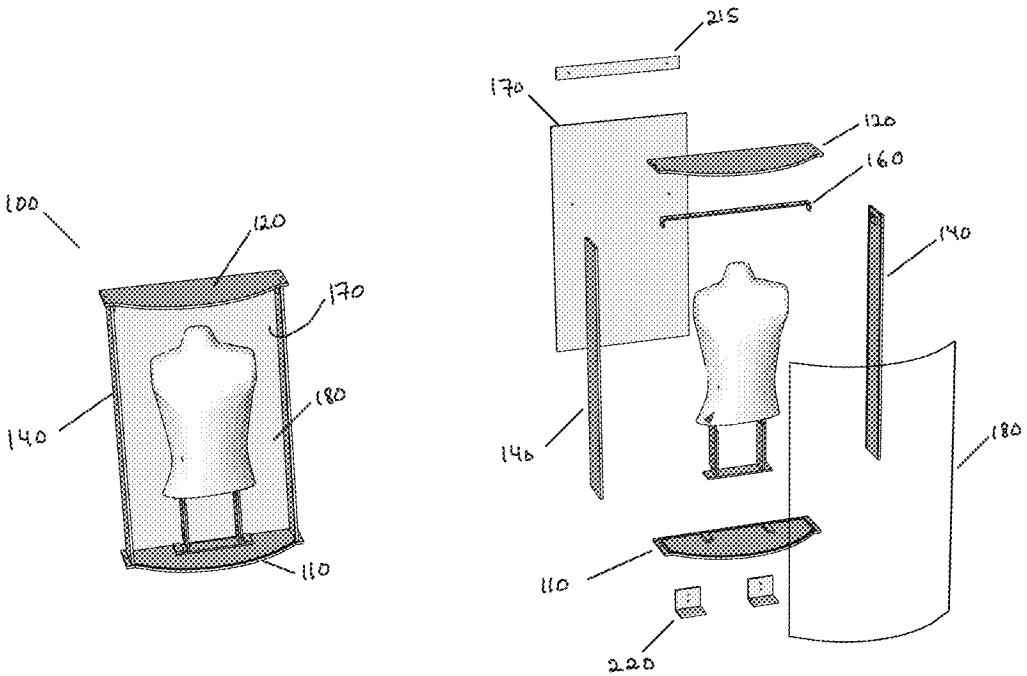
FIG. 2 is an assembled and exploded view of the embodiment of the display case of FIG. 1A.

Referring to FIG. 2, an embodiment of the display case illustrated in FIG. 1A is shown, assembled, and in an exploded view. The display case 100 includes a bottom panel 110, top panel 120, side panels 140, back panel 170, and front panel 180, which together enclose an interior space of the display case. At least the front panel 180 is transparent to provide a view into the display case 100.

Figure 3:
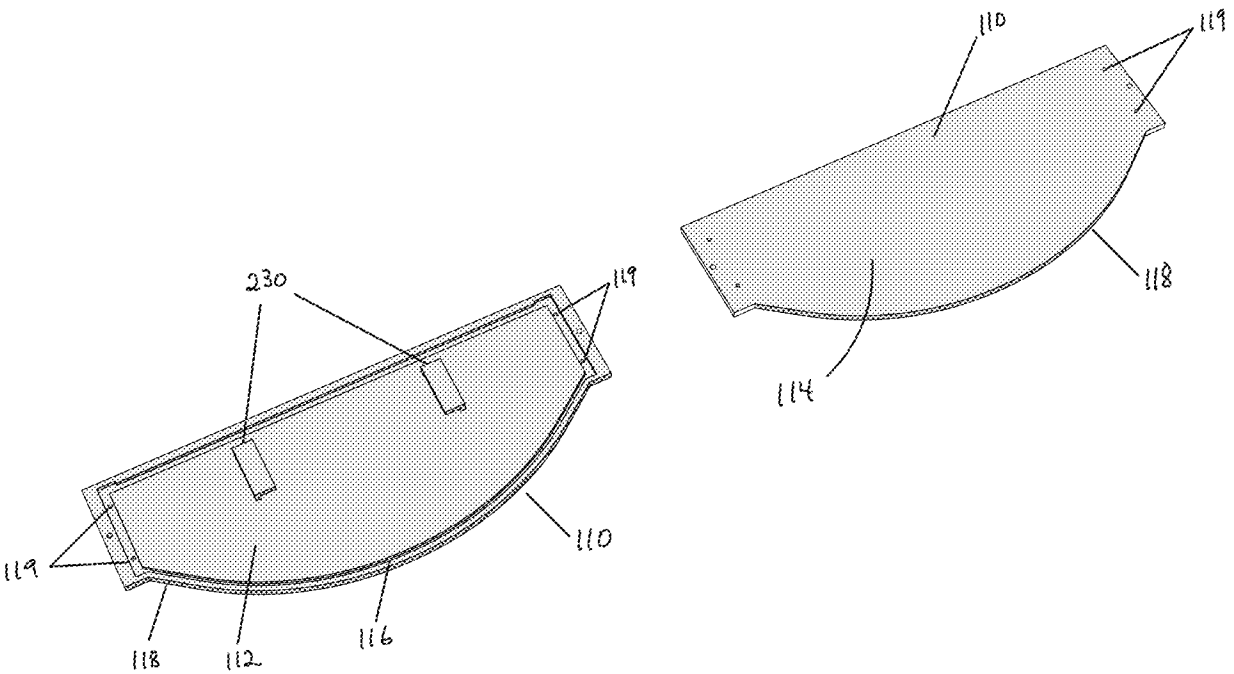
FIG. 3 is a top and bottom perspective view of a bottom panel of the embodiment of the display case of FIG. 2.
Figure 4:
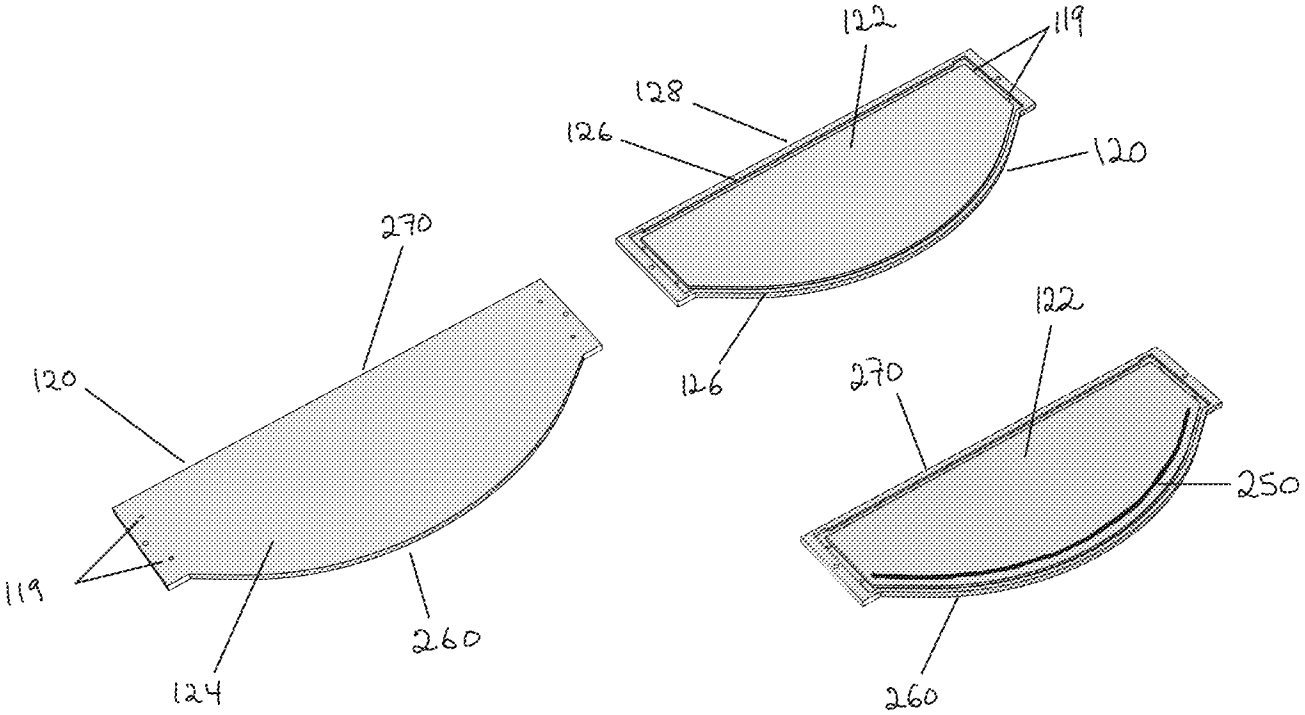
FIG. 4 is a top and bottom perspective view of a top panel of the embodiment of the display case of FIG. 2.

Referring to FIGS. 3 and 4, the bottom panel 110 and top panel 120 each have an inner face 112, 122, and outer face 114, 124. The inner face 112, 122 includes an elongated groove 116, 126 inscribed substantially parallel to an outer edge 118, 128 of the bottom panel 110 and top panel 120, respectively. The top panel and bottom panel elongated grooves 116, 126 include specialty hardware holes 119 that extend from the inner face 112, 122 to the outer face 114, 12.4 of the bottom panel 110, and top panel 120.

Figure 5:
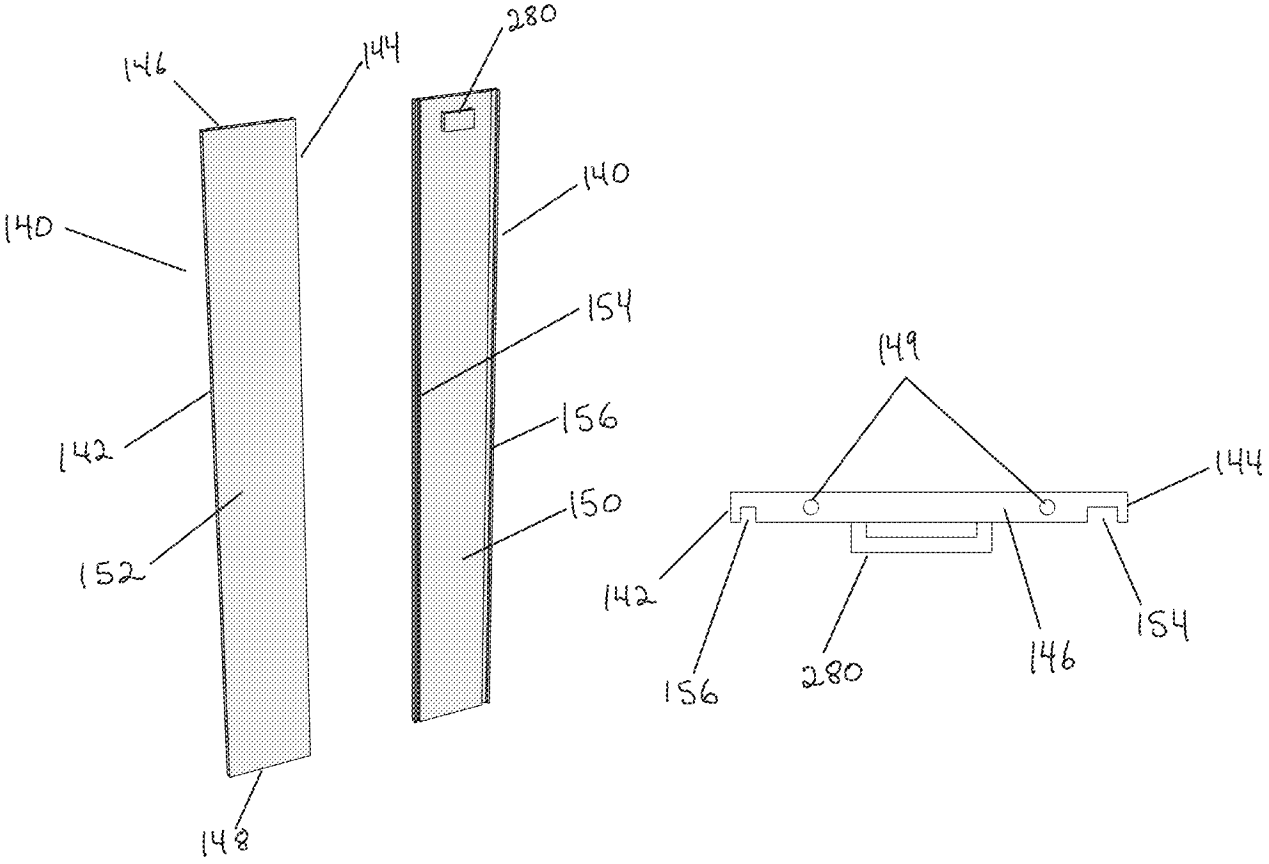
FIG. 5 is an inside and outside perspective view of a side panel of the embodiment of the display case of FIG. 2.

Referring to FIG. 5, the side panels 140 have a front edge 142 and opposing back edge 144, and a top edge 146 and opposing bottom edge 148 extending from the front edge 142 to the back edge 144. The top edge 146 and bottom edge 148 each include a plurality of specialty hardware holes 149. The side panels 140 have an inner face 150 and outer face 152 defined by the front, back, top, and bottom edges 142, 144, 146, 148. The side panel inner face 150 includes a first and second side panel elongated groove 154, 156. The first side panel elongated groove 154 runs substantially parallel to the side panel back edge 144, and the second side panel elongated groove 156 runs substantially parallel to the side panel front edge 142.

Figure 6:
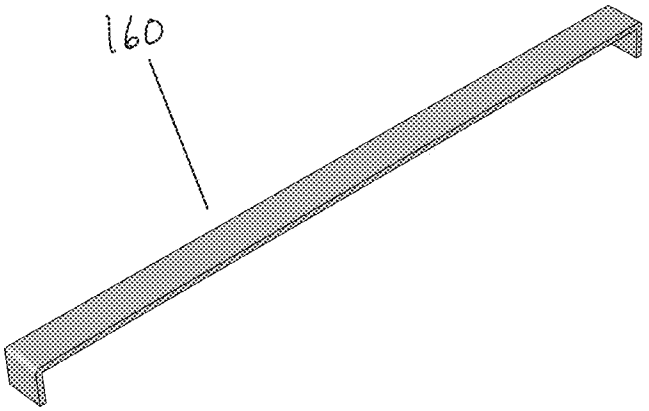
FIG. 6 is a perspective view of a top bracket of the embodiment of the display case of FIG. 2.

Referring again to MG. 2, the side panels 140 join the top panel 120 and bottom panel 110 by inserting the side panel bottom edge 148 into the bottom panel elongated groove 116 and the side panel top edge 146 into the top panel elongated groove 126. The side panels 140 are fastened to the bottom panel 110 and top panel 120 by inserting fasteners into the specialty hardware holes 119, 129, 149 in the bottom panel, top panel, and side panels. A top bracket 160, shown also in FIG. 6, extends between a top portion of the side panels 140 to stabilize the side panels while the display case 100 is assembled.

Figure 7:
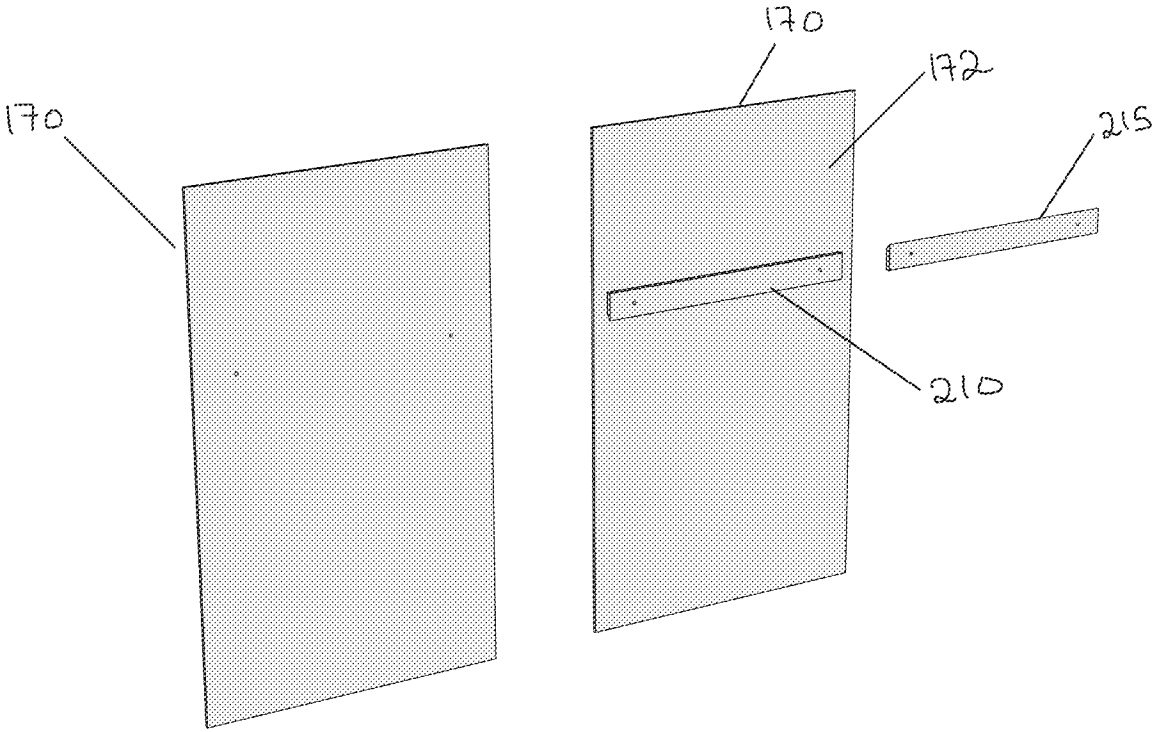
FIG. 7 is a front and rear perspective view of a back panel of the embodiment of the display case of FIG. 2.

Referring to FIGS. 1 and 7, the back panel 170 cooperates with the bottom panel 110, top panel 120, and side panels 140 by inserting the back panel into the bottom panel elongated groove 116, first side panel elongated grooves 154, and the top panel elongated groove 126. The back panel 170 may be transparent, colored, or may display a background picture for a display item, By interchanging the back panel 170, the display case 100 may be easily provided with alternate visual presentations.

Figure 8:
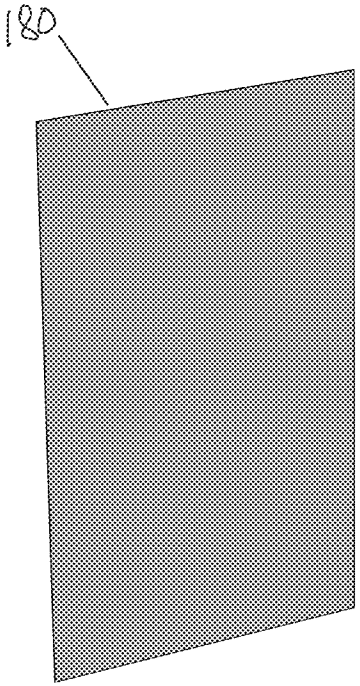
FIG. 8 is a perspective view of a front panel of the embodiment of the display case of FIG. 2.

Referring to FIGS. 1 and 8, the transparent front panel 180 cooperates with the bottom panel 110, top panel 120, and side panels 140 by inserting into the bottom panel elongated groove 116, second side panel elongated grooves 156, and the top panel elongated groove 126.

Referring again to MG. 7, in a further embodiment, the display case 100 includes a wall attachment cleat 210, attached to an outside face 172 of the back panel 170, for securing the display case, for example, to a wall. The attachment cleat 210 may be a V-cleat, with a complementary V-cleat 215 attached to the wall for mounting the display case.

Figure 9:
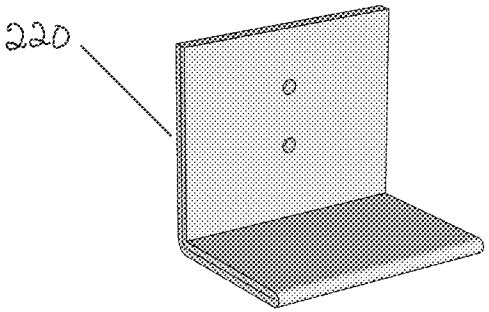
FIG. 9 is a perspective view of a support bracket of the embodiment of the display case of FIG. 2.

Referring to FIG. 9, in a further embodiment, the display case 100 includes a bottom bracket 220 that attaches to the wall and abuts the bottom panel outer face 114, to further secure the display case to the wall.

Figure 10:
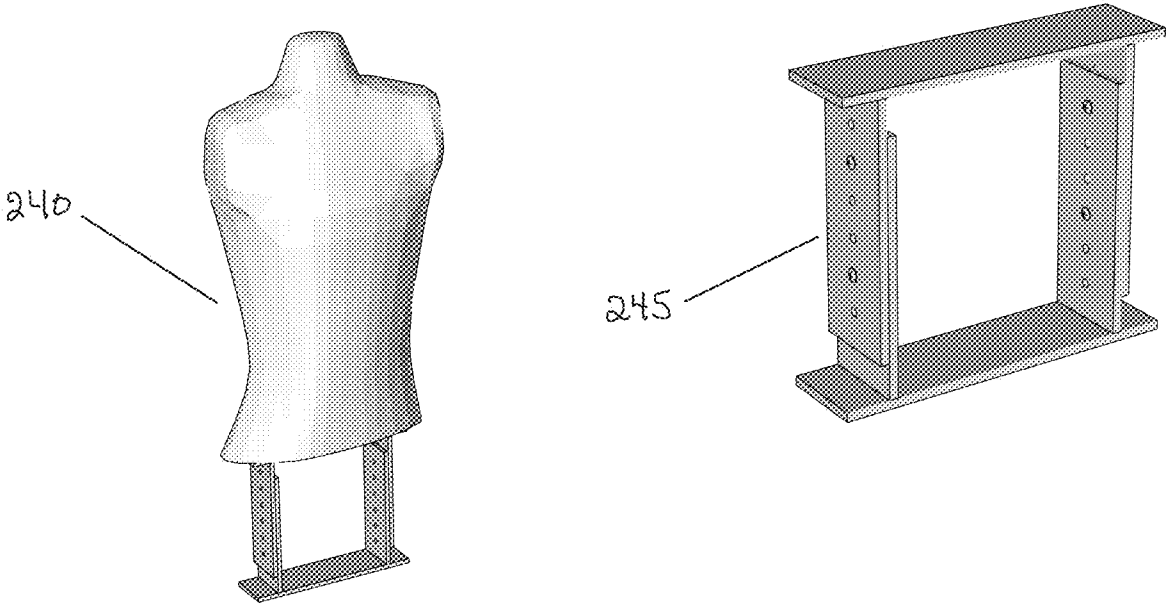
FIG. 10 is a perspective view of a display item support and adjustable stand of the embodiment of the display case of FIG. 2.
Figure 11A:
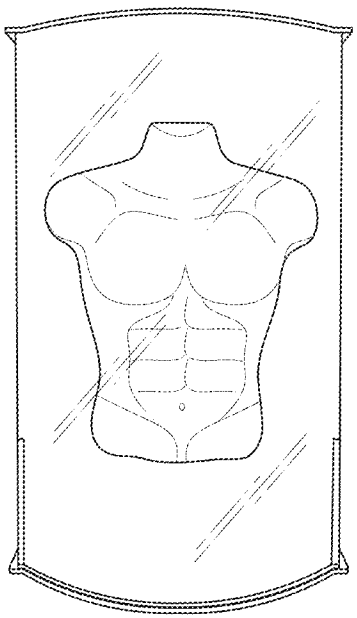
FIG. 11A-D is a front, side and back view of the embodiment of the display case of FIG. 2.
Figure 11B:
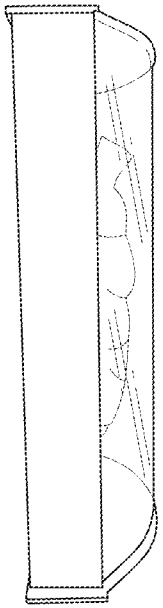
Figure 11C:
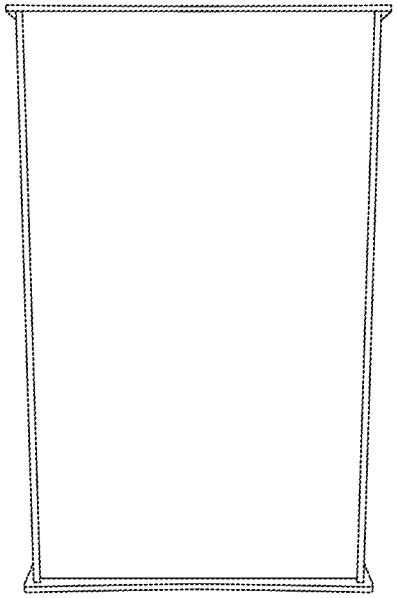
Figure 11D:
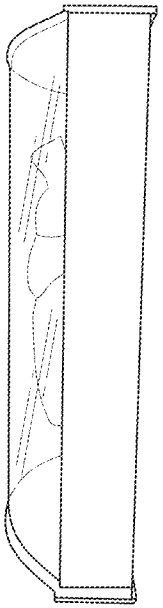

In a further embodiment, the display case 100 includes a mount 230 attached to an inner face of the bottom panel, side panels, back panel, or top panel. The mount 230 may be a cleat, hook, or another type of mount. In an embodiment illustrated in FIG. 3, the mount 230 is a holder attached to the bottom panel inner face 112. As further illustrated in FIG. 10, a support 240 for a display item is attached to the mount 230. The display item support 240 may include a human body part shape, for example, a mannequin to display a collectible sport jersey, or may be another format for displaying other collectible items. The display item support may also be adjustable 245, for example, in height.

In a further embodiment, a frame for holding a picture, an engraved plaque or a custom logo is attached to the display case 100, for example, to the bottom panel 110.

In an embodiment, the display case panels are made of plastic, for example, acrylic, polyvinyl chloride, Lexan, or a mirror. The front and/or back panels 180, 170 may be made of flexible material.

Referring again to FIG. 4, in a further embodiment, the top panel 120 includes an elongated opening 250 in proximity and approximately parallel to a front edge 260 of the top panel 120. The elongated opening 250 can be used to remove and re-insert, the front panel 180 without disassembling the display case, thereby allowing display items to be easily exchanged.

Referring again to FIG. 5, the top bracket 160 may be held in place between the side panels 140 with side panel cleats 280, each side panel cleat affixed to the inner face 150 of opposing side panels 140.

Figure 12B:
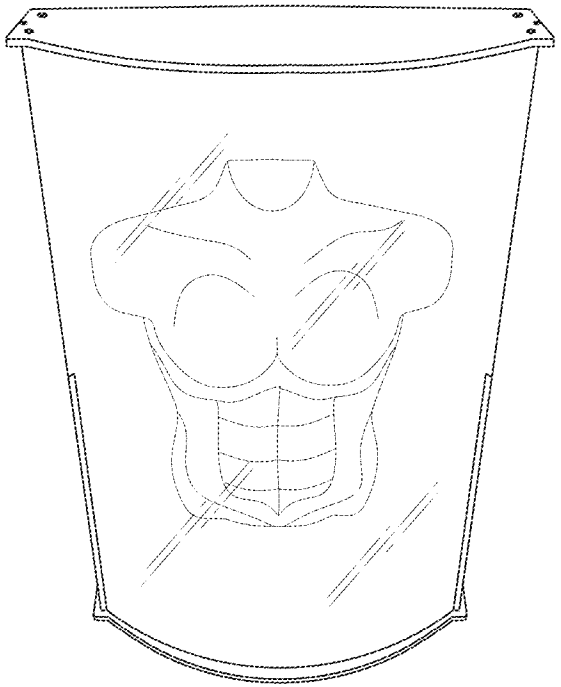
FIG. 12A-B is a disassembled and assembled view of the embodiment of the display case of FIG. 2.
Figure 12A:
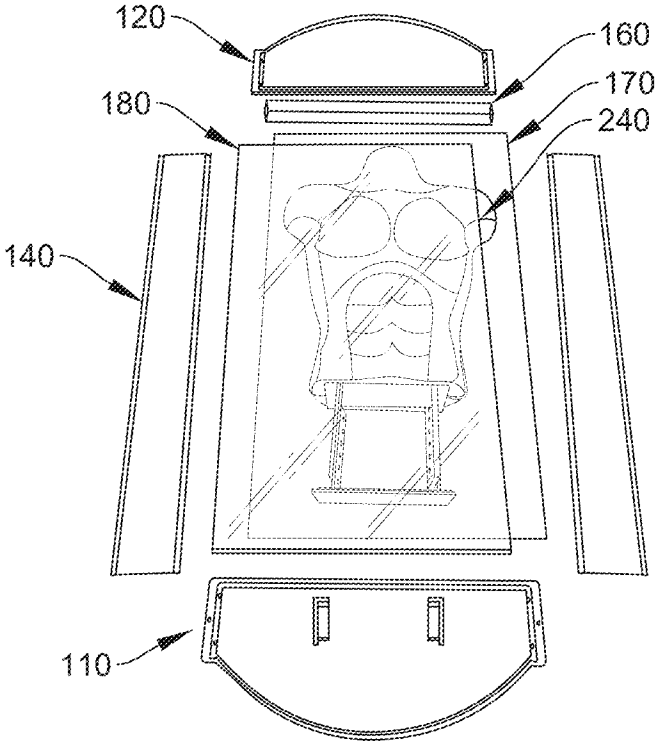

Referring now to FIGS. 11, 12, and 13, a method for assembling a display case 100 is provided. The display case 100 is shown from the front side, left side, back side, and right side (FIGS. 11A, 11B, 11C, and 11D, respectively) and disassembled (FIG. 12A) and assembled (FIG. 12B).

Figure 13C:
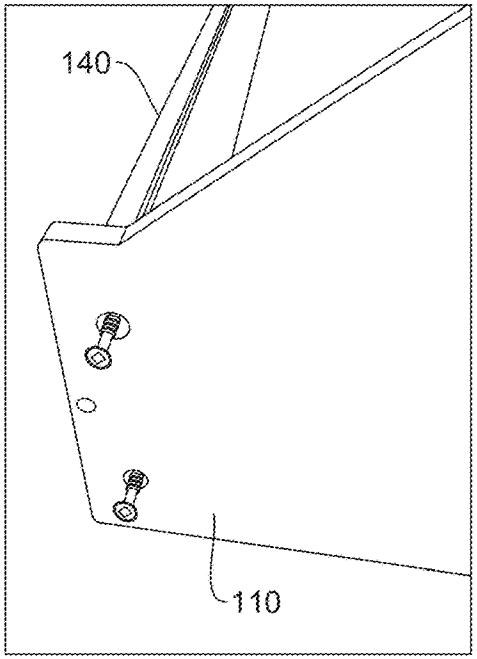
FIG. 13A-K illustrates assembly of the embodiment of the display case of FIG. 2.
Figure 13B:
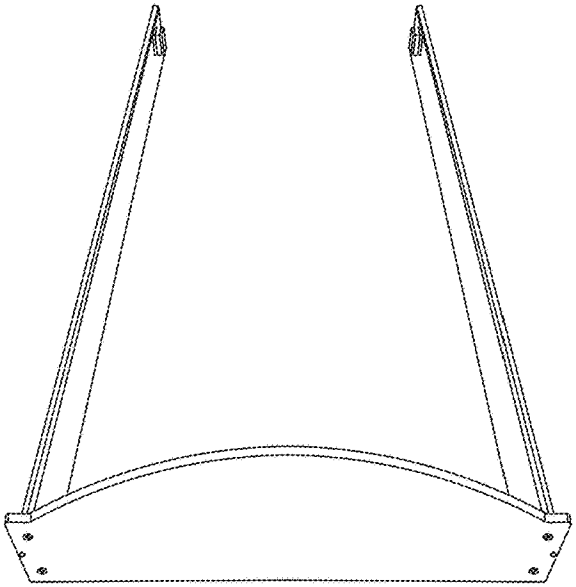
Figure 13A:
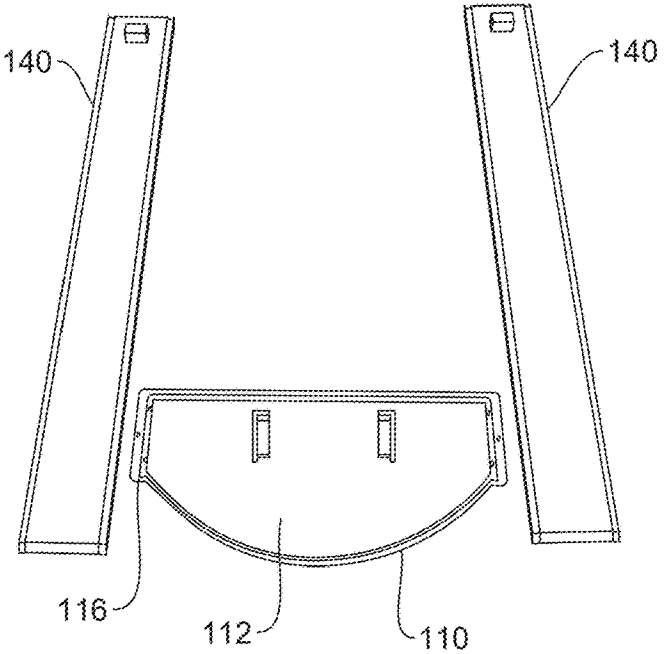
Figure 13G:
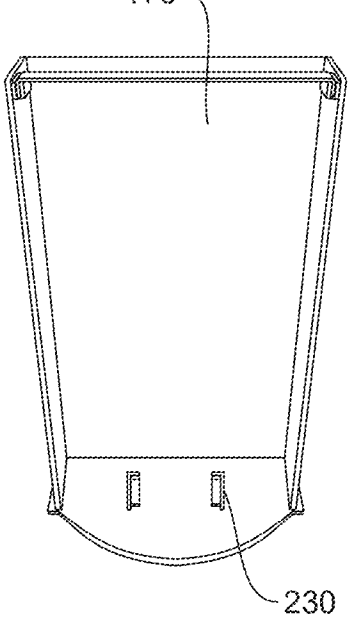
Figure 13F:
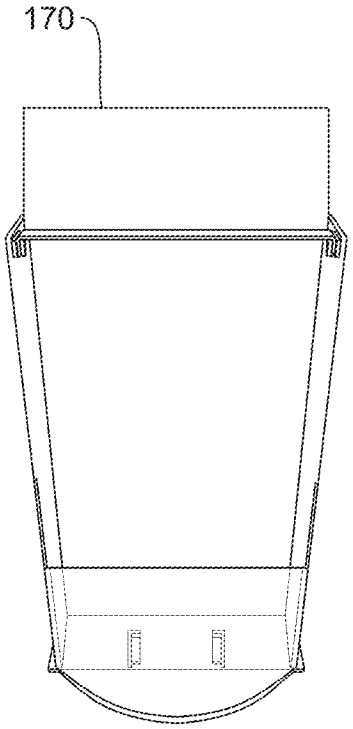
Figure 13E:
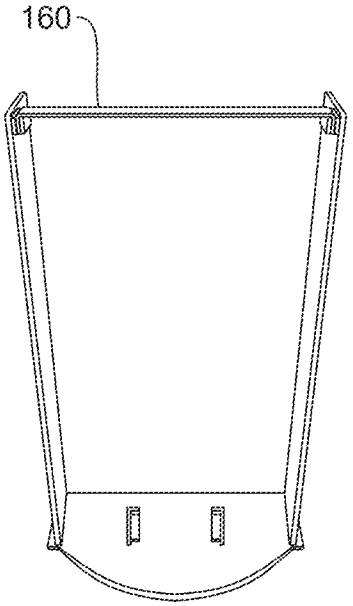
Figure 13D:
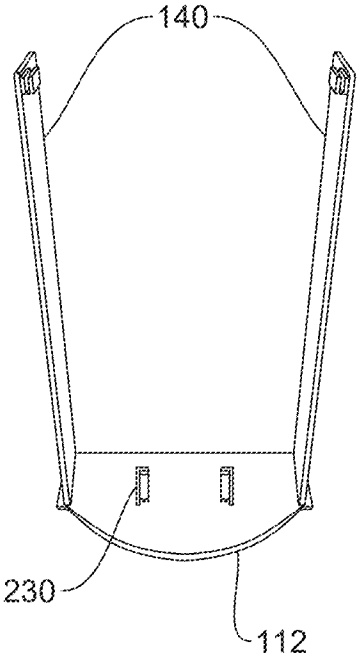
Figure 13K:
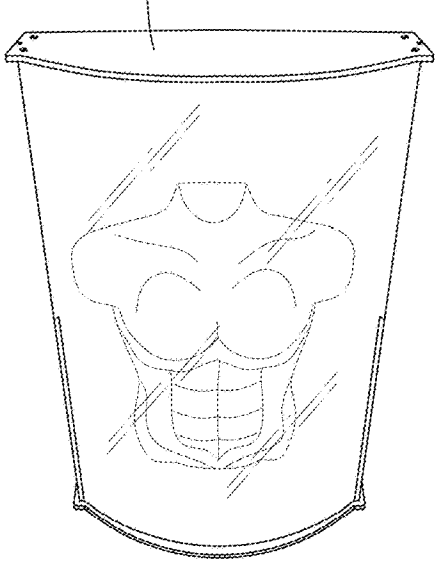
Figure 13J:
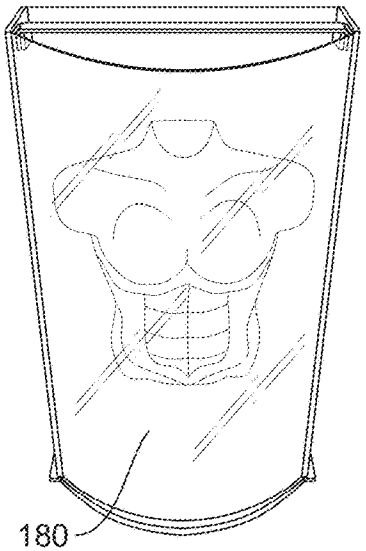
Figure 13I:
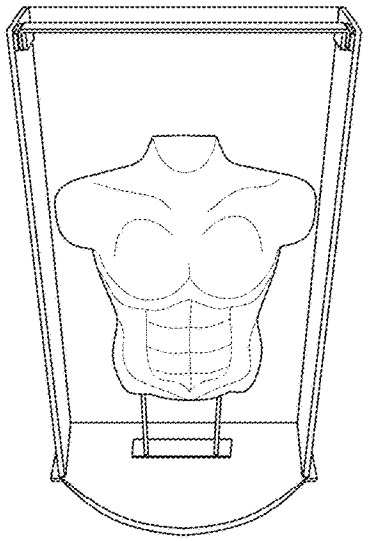
Figure 13H:
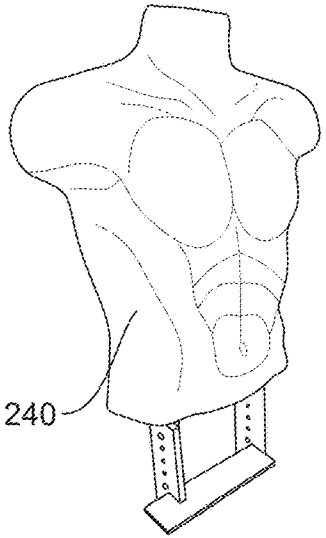
Figure 14A:
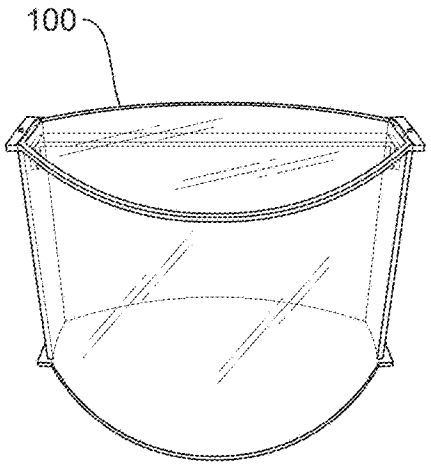
FIG. 14A-D is a front, side and back perspective view of another embodiment of the display case of the present disclosure.
Figure 14B:
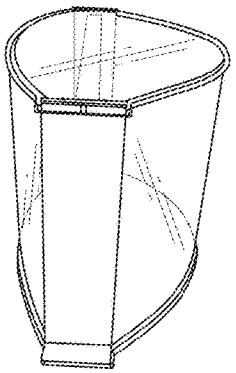
Figure 14C:
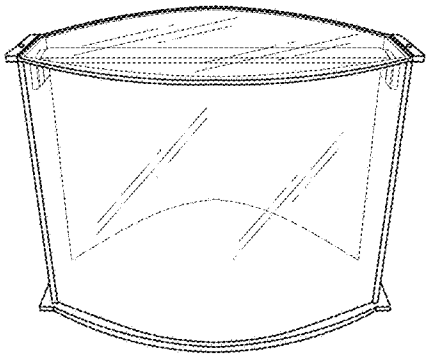
Figure 14D:
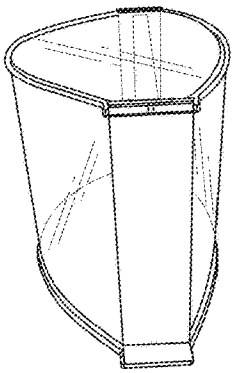

As provided in FIGS. 13A and B, a first and second side panel 140 are joined to a bottom panel 110 by inserting the side panels into an elongated groove 116 in an inner face 112 of the bottom panel. In FIG. 13C, the side panels 140 are secured to the bottom panel 110 with fasteners through the bottom panel and side panel specialty hardware holes 119, 149. In FIG. 13D, the display case is stood up, and in FIG. 13E a top bracket 160 is attached between a top portion of the side panels 140 to stabilize the side panels. In FIGS. 13F and 13G a back panel 170 is inserted into a first elongated groove 154 in an inner face 150 of each of the side panels 140 and into the elongated groove 116 in the inner face 112 of the bottom panel 110. In FIG. 13J, a transparent front panel 180 is inserted into a second elongated groove 156 in the inner face 150 of each side panel 140 and the elongated groove 116 in the inner face 112 of the bottom panel 110. In FIG. 13K, a top panel 120 is joined by inserting the side panels 140, back panel 170, and front panel 180 into an elongated groove 126 in an inner face 122 of the top panel 120. The top panel 120 is secured to the side panels 140 with fasteners through specialty hardware holes 129, 149 in the top panel 120, and the side panels 140.

Referring to FIGS. 2, 7, and 9, in a thither embodiment of the method, the display case 100 is attached to a wall, for example by using a V-cleat 210 attached to the back panel 170 to a complementary V-cleat 215 attached to the wall. The display case 100 may be further secured to the wall by mounting a bottom bracket 220 to the wall, such that the bottom bracket abuts the bottom panel outer face 114 and supports the display case.

In a further embodiment of the method, a mount 230 is attached to a bottom, side, back, or top panel of the display case. For example, in FIG. 13D-I, a mount 230 is attached to the bottom panel inner face 112, and a display item support 240 is attached to the mount. A display item, such as a collectible item, for example, a sports jersey, may be positioned on the display item support 240.

As illustrated in FIG. 4, in a further embodiment of the method, the front panel 180 may be removed through an elongated opening 250 in proximity to a front edge 260 of the top panel 120, thus allowing display items to be interchanged with ease.

Figure 15B:
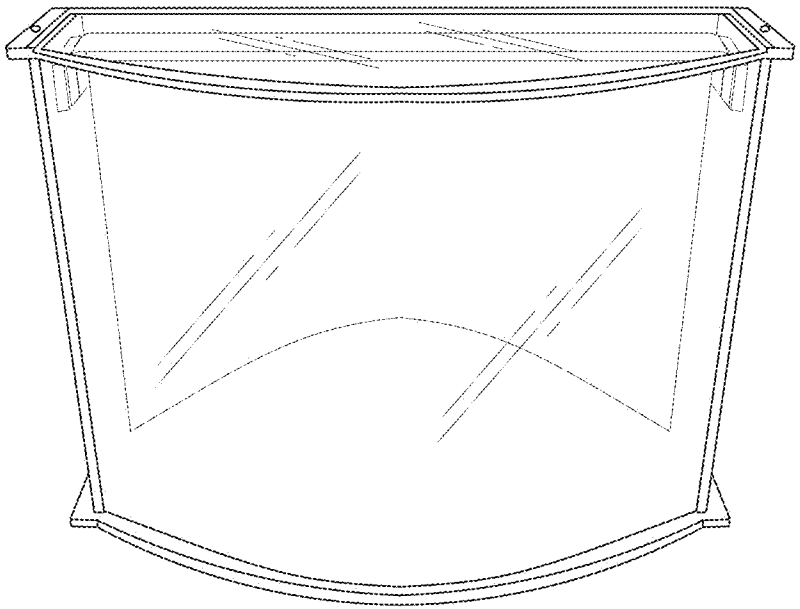
FIG. 15A-B is a disassembled and assembled view of the embodiment of the display case of FIG. 14.
Figure 15A:
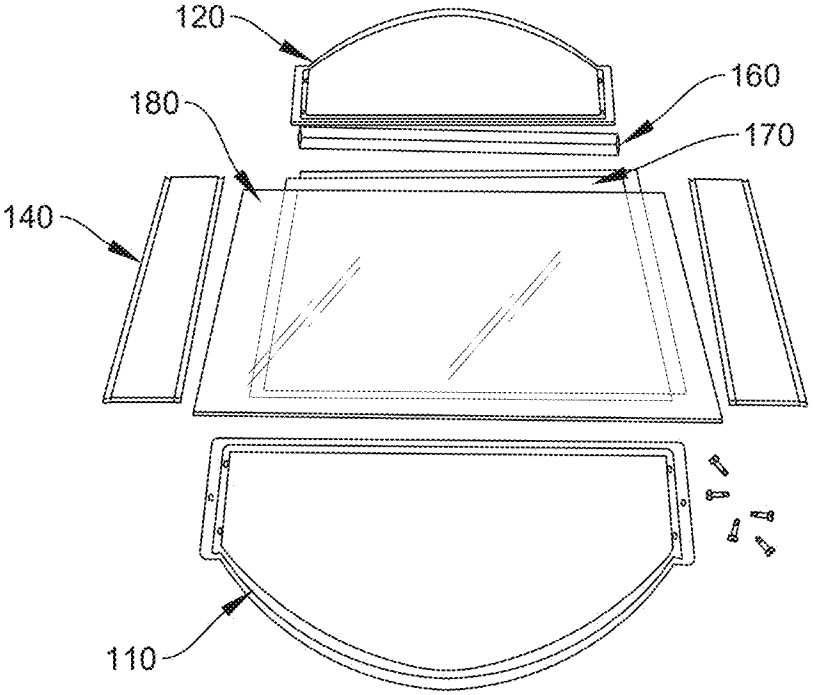

Referring now to FIGS. 14, 15, and 16, a method for assembling another embodiment of a display case 100 is provided. The display case 100 is shown from the front side, left side, back side, and right side (FIGS. 14A, 14B, 14C, and 14D, respectively), and disassembled (FIG. 15A) and assembled (FIG. 15B).

Figure 16C:
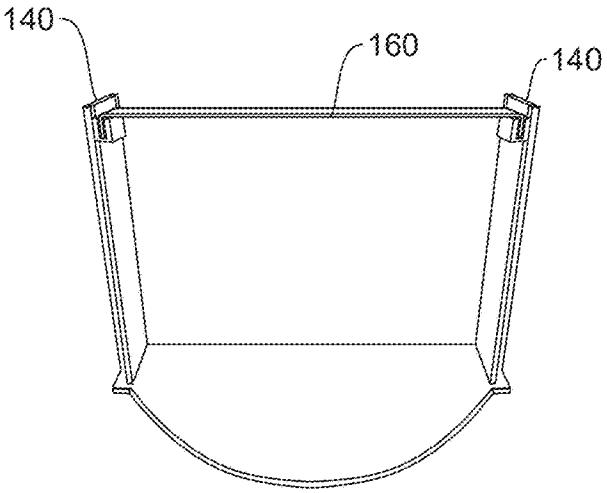
FIG. 16A-F illustrates assembly of the embodiment of the display case of FIG. 14.
Figure 16B:
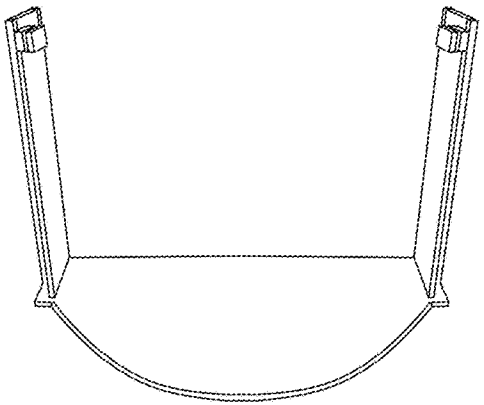
Figure 16A:
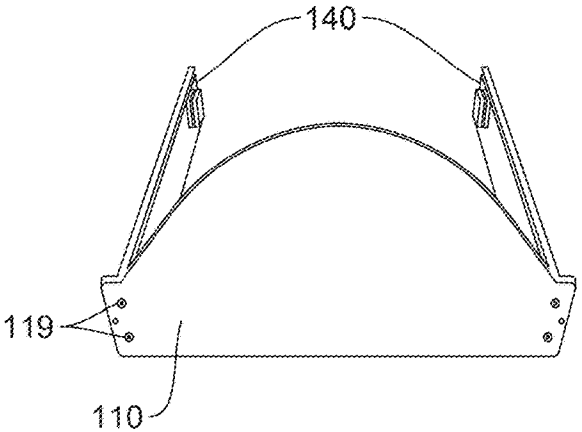
Figure 16D:
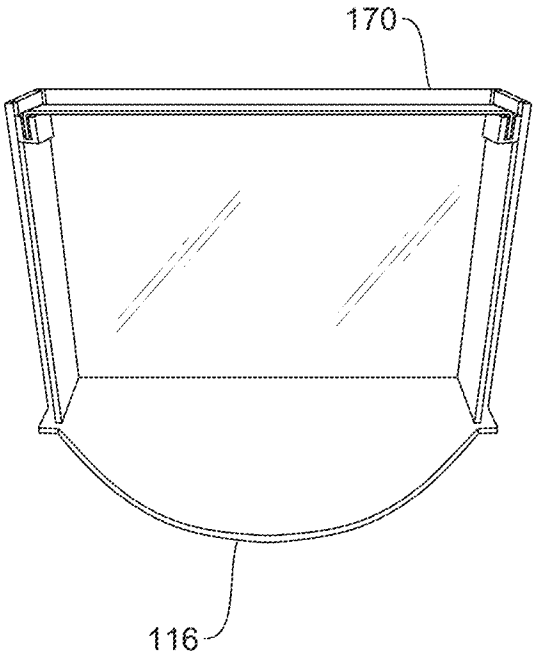
Figure 16E:
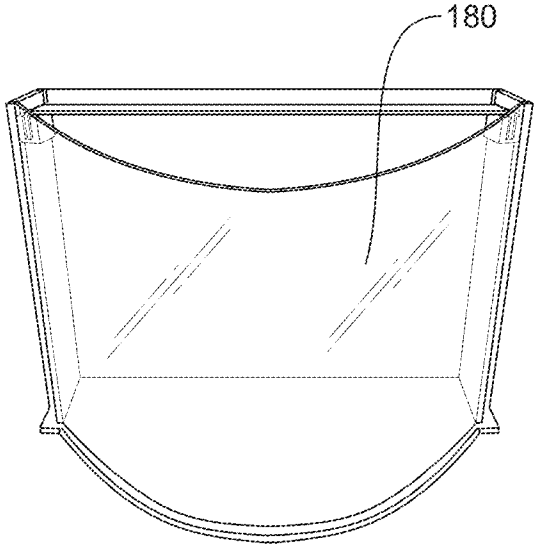
Figure 16F:
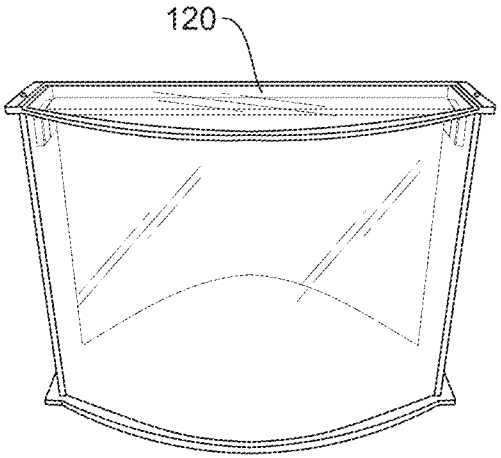

As provided in FIG. 16A, a first and second side panel 140 are joined to a bottom panel 110 by inserting the side panels into an elongated groove 116 in an inner face 112 of the bottom panel. The side panels 140 are secured to the bottom panel 110 with fasteners through the bottom panel and side panel specialty hardware holes 119, 149. In FIG. 16B, the display case is stood up, and in FIG. 16C, a top bracket 160 is attached between a top portion of the side panels 140 to stabilize the side panels. In FIG. 16D, two back panels 170 are inserted into a first elongated groove 154 in an inner face 150 of each of the side panels 140 and into the elongated groove 116 in the inner face 112 of the bottom panel 110. In FIG. 16E, a transparent front panel 180 is inserted into a second elongated groove 156 in the inner face 150 of each side panel 140 and the elongated groove 116 in the inner face 112 of the bottom panel 110, In FIG. 16F, a top panel 120 is joined by inserting the side panels 140, back panels 170, and front panel 180 into an elongated groove 126 in an inner face 122 of the top panel 120. The top panel 120 is secured to the side panels 140 with fasteners through specialty hardware holes 129, 149 in the top panel 120, and the side panels 140.

While embodiments of the device and method have been illustrated in the accompanying drawings and described hereinabove, it will be appreciated by those skilled in the art that various modifications, alternate constructions, and equivalents may be employed. It should be further understood that the claims are not intended to be limited to the particular forms disclosed but rather to cover all modifications, equivalents, and alternatives falling within the spirit and scope of this disclosure.

Therefore, the above description and illustrations should not be construed as limiting the scope of the invention, which is defined in the appended claims.

What is claimed is:

1. A display case comprising:

a bottom panel and a top panel, the bottom panel and top panel each having an inner face and an outer face, the inner face of the top panel and bottom panel comprising:

an elongated groove extending peripherally along and inscribing the inner face substantially parallel to respective outer edges of the inner face and including a plurality of specialty hardware holes extending from the inner face elongated groove to the outer face;

first and second opposing side panels, each side panel having a side panel front edge and an opposing side panel back edge;

a side panel top edge and an opposing side panel bottom edge, the top edge and bottom edge each extending from the side panel front edge to the side panel back edge and including a plurality of specialty hardware holes extending into the top edge and the bottom edge;

a side panel inner face and a side panel outer face defined by the side panel front edge, back edge, top edge, and bottom edge, the side panel inner face comprising:

a first and second side panel elongated groove substantially parallel to the side panel back edge and the side panel front edge, respectively;

wherein the first and second side panels join the top panel and the bottom panel by inserting the side panel bottom edge into the bottom panel elongated groove and the side panel top edge into the top panel elongated groove and fastening the bottom panel and top panel through the specialty hardware holes in the bottom panel, the top panel, and the side panels;

a top bracket that extends from a top portion of the first side panel to a top portion of the second side panel;

a back panel that cooperates with the bottom panel, top panel, and first and second side panels by inserting into the bottom panel elongated groove, the first side panel elongated grooves, and the top panel elongated groove; and a transparent front panel that cooperates with the bottom panel, top panel, and first and second side panels by inserting into the bottom panel elongated groove, the second side panel elongated grooves, and the top panel elongated groove to form an interior space.

2. The display case as in claim 1, further comprising a wall attachment cleat attached to an outside face of the back panel, for securing the display case to a wall.

3. The display case as in claim 2, wherein the wall attachment cleat comprises a V-cleat.

4. The display case as in claim 1, further comprising a bottom bracket abutting the bottom panel outer face, for supporting the display case against a wall.

5. The display case as in claim 1, further comprising a mount attached to the bottom, top or side panel inner face or a back panel inner face, and a display item support attached to the mount.

6. The display case as in claim 5, wherein the display item support comprises a human body part shape.

7. The display case as in claim 5, wherein the display item support comprises a collectible item support.

8. The display item as in claim 5, wherein the display item support comprises a collectible garment support.

9. The display case as in claim 5, wherein the display item support comprises an adjustable stand.

10. The display case as in claim 1, wherein the bottom panel, top panel, back panel, front panel and side panels comprise plastic or mirror.

11. The display case as in claim 10 wherein the plastic comprises acrylic, polyvinyl chloride, or Lexan.

12. The display case as in claim 1 wherein at least one of the front panel and the back panel comprise flexible material.

13. The display case as in claim 1, wherein the top panel further comprises an elongated opening in proximity to a front edge of the top panel, for removing the front panel from the display case.

14. The display case as in claim 1, wherein the top bracket is supported by a first and second side panel cleat, each side panel cleat affixed to the inner face of the opposing side panels.

15. A method for assembling a display case comprising:

joining a first and second side panel to a bottom panel by inserting the first and second side panels into an elongated groove extending peripherally along outer edges in an inner face of the bottom panel;

securing the side panels to the bottom panel with fasteners through specialty hardware holes in the bottom panel and the side panels;

attaching a top bracket to an upper portion of the first and second side panels to stabilize the side panels;

inserting a back panel into a first elongated groove in an inner face of each of the side panels and the elongated groove in the inner face of the bottom panel;

inserting a transparent front panel into a second elongated groove in the inner face of each of the side panels and the elongated groove in the inner face of the bottom panel;

joining a top panel by inserting the side panels, back panel and front panel into an elongated groove extending peripherally along outer edges in an inner face of the top panel; and securing the top panel to the side panels with fasteners through specialty hardware holes in the top panel and the side panels.

16. The method of claim 15, further comprising attaching the display to a wall and wherein mounting the display case comprises mounting a V-cleat attached to the back panel to a complementary V-cleat attached to the wall.

17. The method of claim 15, wherein mounting the display case comprises mounting a bottom bracket abutting the bottom panel outer face to a wall.

18. The method of claim 17, further comprising attaching a mount to the bottom or side panel inner face or a top panel inner face and attaching a display item support to the mount.

19. The method of claim 15, further comprising positioning a collectible item on a display item support.

20. The method of claim 15, further comprising removing the front panel through an elongated opening in proximity to a front edge of the top panel.

* * * * *